United States Patent [19]

Schneider

[11] 4,330,594

[45] May 18, 1982

[54] SURFACE PROTECTION FOR PARTS OF A HOT-TINNING SYSTEM

[75] Inventor: Kurt Schneider, Munich, Fed. Rep. of Germany

[73] Assignee: Siemens Aktiengesellschaft, Berlin & Munich, Fed. Rep. of Germany

[21] Appl. No.: 135,071

[22] Filed: Mar. 28, 1980

[30] Foreign Application Priority Data

Apr. 5, 1979 [DE] Fed. Rep. of Germany ..... 2913805

[51] Int. Cl.[3] ..... B05C 11/06

[52] U.S. Cl. ..... 428/422; 118/63; 118/424; 118/503; 427/439; 427/349; 428/469

[58] Field of Search ..... 427/360, 433, 34, 359, 427/349; 228/20, 22, 23, 31, 30; 118/424, 63, 503; 428/422, 469

[56] References Cited

U.S. PATENT DOCUMENTS

| | | | |
|---|---|---|---|
| 2,797,476 | 7/1957 | Sendzimiv | 427/433 |
| 3,066,041 | 11/1962 | Busch | 427/360 |
| 3,980,218 | 9/1976 | Fortune | 228/20 |

FOREIGN PATENT DOCUMENTS

| | | | |
|---|---|---|---|
| 2446169 | 4/1976 | Fed. Rep. of Germany | 427/34 |
| 136114 | 6/1979 | German Democratic Rep. | 427/34 |
| 1431061 | 4/1976 | United Kingdom . | |

*Primary Examiner*—Ralph S. Kendall

*Attorney, Agent, or Firm*—Hill, Van Santen, Steadman, Chiara & Simpson

[57] ABSTRACT

A surface protection for a hot-tinning system or soldering system particularly useful for the air jets of the system characterized by the surfaces of the parts, which come into contact with the solder during the process, being provided with a non-metallic, heat resistant layer. The layer, which preferably has a thickness range of between 0.2 and 0.4 mm, may be an $Al_2O_3$ ceramic layer, which is preferably applied by a plasma spraying process, or may be a polytetrafluoroethylene coating. It is further desireable that the surface, which is to be protected by the heat resistant layer, is provided as a sand blasted surface which has been provided with an adhesion layer consisting of Ni-Mo-Al alloy.

8 Claims, No Drawings

SURFACE PROTECTION FOR PARTS OF A HOT-TINNING SYSTEM

BACKGROUND OF THE INVENTION

The present invention is directed to a surface protection for the surfaces of parts of a hot-tinning system particularly the surface of hot air jets used in the process.

In a hot-tinning process, the excess solder is uniformly blown off of the treated work piece, for example, a printed circuit board by means of flow of hot air at a temperature of approximately 260° C. that is directed by the assistance of air jets having slits or slots. Due to the air turbulence that occurs, the parts of the system coming into contact with the solder, particularly the slit jets become sprinkled or splattered with flux, dross, and tin dust. This spraying or sprinkling leads to an agressive deposit and finally to the blockage of the slit at the jet. In this case, the only alleviation of this condition is the cleaning of the jet.

Hitherto, the slit jets have been hard chromium plated and the guard rails as well as the solder frames were manufactured out of a stainless steel. These measures proved insufficient because the splattering or sprinkling particularly at the slit jets always occured due to the repeated work steps. The hard chromium plated surface of the slit jets were also attacked due to the long influence of these deposits and were partially destroyed. Therefore cleansing of the contaminated slit jets and other parts became necessary at shorter and shorter intervals. Cleaning of the machine parts particularly the slit jets involves a great outlay because the machine must be cooled off and then taken apart for the cleaning purposes. In addition, the hardened or solidified tin is not only difficult to remove from the lips of the slit jet, but the hard chromium plated layer is often removed over a long duration of the operation of the machine either due to the etching of the layer by flux or by alloying of the layer with other materials such as the solder.

SUMMARY OF THE INVENTION

The present invention is directed to creating a surface protection for those parts of a hot-tinning or soldering system particularly for the hot air jets which is significantly less sensitive to the problems of deposit than the presently known surface protection so that the system will needless servicing and the servicing is more simple.

This object is inventively achieved by protecting the surfaces of at least those parts that are exposed to the undesired contact with a non-metallic heat resistant layer. It is particularly advantageous when the surfaces of these parts are provided with an $Al_2O_3$ ceramic layer applied preferably by means of a plasma spraying so that it is a plasma sprayed $Al_2O_3$ layer. These layers are preferably in a thickness range of 0.2 to 0.4 mm. In addition to using the $Al_2O_3$ ceramic layer, another possibility consists in using a polytetrafluoroethylene coating which is in a thickness range of 0.2 to 0.4 mm.

By means of the protective coating or layer the dampening or the wetting of the surface due to the contacting of the solder is reliably prevented. Any potential contamination can be stripped away while the contamination is in either the cold state or the warm state. It is particularly advantageous that the machine need no longer be taken apart in order to clean the surfaces of the jets.

The surface protection is expedient for all parts of the system which comes in contact with solder during a hot-tinning process. Thus for example, the surface protection layer of either a $Al_2O_3$ ceramic or a polytetrafluoroethylene is used for work holders and clamps used for clamping parts during the soldering process.

By utilizing the layer of the present invention, the hard chromium plating of the surfaces of the parts can be omitted. To improve the adhesion of the $Al_2O_3$ layer, it is desireable to provide the surfaces with a sand blasted surface before the coating and then provide an adhesion layer consisting of Ni-Mo-Al alloy before applying the protective coating or layer. The adhesion layer of Ni-Mo-Al alloy on a sand blasted surface can also be used under the polytetrafluoroethylene layer.

Although various minor modifications may be suggested by those versed in the art, it should be understood that I wish to embody within the scope of the patent granted hereon, all such modifications as reasonably and properly come within the scope of my contribution to the art.

I claim:

1. A surface protection for surfaces of air jets of a hot-tinning system, said protection being provided on surfaces of air jets coming into contact with a solder during a hot-tinning process, said air jet surfaces being provided with a non-metallic, heat resistant layer selected from a group consisting of $Al_2O_2$ ceramic layer and polytetrafluoroethylene layer.

2. A surface protection according to claim 1, wherein the heat resistant layer has a thickness in the range of 0.2 to 0.4 mm.

3. A surface protection according to claim 1, wherein said layer is an $Al_2O_3$ ceramic layer.

4. A surface protection according to claim 1, wherein said layer is a polytetrafluoroethylene layer.

5. A surface protection according to claim 4, wherein said layer has a thickness range of 0.2 to 0.4 mm.

6. A surface protection for surfaces of air jets of a hot-tinning system, said protection being provided on surfaces of air jets coming into contact with a solder during a hot-tinning process, said air jet surfaces being provided with a non-metallic, heat resistant layer consisting of an $Al_2O_2$ ceramic layer.

7. A surface protection according to claim 6, wherein said ceramic layer is a plasma sprayed $Al_2O_3$ layer.

8. A surface protection according to claim 6, wherein said layer has a thickness range of 0.2 to 0.4 mm.

* * * * *